US007237420B2

(12) United States Patent
Berghaus

(10) Patent No.: US 7,237,420 B2
(45) Date of Patent: Jul. 3, 2007

(54) DEVICE FOR THE PLASTIC DEFORMATION OF WORK PIECES

(75) Inventor: Gerd Berghaus, Kürten (DE)

(73) Assignee: Voss Fluid GmbH & Co. KG, Ludenscheider (DE)

( * ) Notice: Subject to any disclaimer, the term of this patent is extended or adjusted under 35 U.S.C. 154(b) by 150 days.

(21) Appl. No.: 10/511,195

(22) PCT Filed: Mar. 17, 2003

(86) PCT No.: PCT/EP03/02731

§ 371 (c)(1),
(2), (4) Date: Mar. 14, 2005

(87) PCT Pub. No.: WO03/086679

PCT Pub. Date: Oct. 23, 2003

(65) Prior Publication Data

US 2005/0150270 A1 Jul. 14, 2005

(30) Foreign Application Priority Data

Apr. 12, 2002 (DE) ..... 202 05 807 U

(51) Int. Cl.
*B21D 41/00* (2006.01)

(52) U.S. Cl. ..... 72/318; 72/316; 72/312

(58) Field of Classification Search ..... 72/318, 72/316, 402, 453.02, 453.07, 453.08, 312, 72/370.11; 29/252
See application file for complete search history.

(56) References Cited

U.S. PATENT DOCUMENTS

| | | | | |
|---|---|---|---|---|
| 410,000 | A * | 8/1889 | Matheson | 72/318 |
| 2,438,999 | A * | 4/1948 | Hartley et al. | 72/20.3 |
| 2,464,510 | A * | 3/1949 | Hull | 72/312 |
| 5,134,872 | A * | 8/1992 | Ose | 72/318 |
| 5,253,506 | A * | 10/1993 | Davis et al. | 72/402 |
| 5,709,121 | A * | 1/1998 | Camping | 72/316 |
| 6,508,097 | B2 * | 1/2003 | Ose | 72/312 |
| 2001/0035038 | A1 | 11/2001 | Ose | |

FOREIGN PATENT DOCUMENTS

| | | |
|---|---|---|
| DE | 94 10 419.0 | 11/1994 |
| DE | 195 11 447 | 10/1996 |
| DE | 297 20 321 | 3/1998 |
| DE | 100 40 595 | 3/2002 |
| WO | WO 02/13992 | 2/2002 |

* cited by examiner

*Primary Examiner*—Daniel C. Crane
(74) *Attorney, Agent, or Firm*—Brinks Hofer Gilson & Lione

(57) ABSTRACT

The present invention relates to a device for the deformation of workpieces, in particular for the plastic shaping of pipe ends, with a shaping unit actuated by the pressure of a fluid and with a prestressing unit arranged on a common longitudinal axis and actuated by the pressure of a fluid and also with clamping elements of conical design which can be clamped by means of the prestressing unit, in each case at least one separate pressure space being designed in the shaping unit and in the prestressing unit, which space can be pressurized independently of the pressure space of the other unit in each case. In this connection, the shaping unit and the prestressing unit are interconnected but completely closed off in relation to one another.

19 Claims, 2 Drawing Sheets

DEVICE FOR THE PLASTIC DEFORMATION OF WORK PIECES

The present invention relates to a device for the deformation of workpieces, in particular for the plastic shaping of pipe ends, with a shaping unit actuated by the pressure of a fluid and with a prestressing unit arranged on a common longitudinal axis and actuated by the pressure of a fluid and also with clamping elements of conical design which can be clamped by means of the prestressing unit, in each case at least one separate pressure space being designed in the shaping unit and in the prestressing unit, which space can be pressurized independently of the pressure space of the other unit in each case.

Devices for the plastic shaping of pipe ends are known in various embodiments. In the most simple form, they are made with only a shaping cylinder, that is to say without an additional clamping cylinder. In this case, conical halves of clamping jaws used as clamping elements are pushed by manual operation into a conical counterplate and are consequently slightly prestressed before the shaping process is initiated. In pipe-shaping operations in which exact axial positioning of the pipe is required, this method is not reliable as the pipe may slip through the clamping jaws. Furthermore, this method is not operator-friendly as several manual activities have to be performed which consist in placing the clamping jaws around the pipe, inserting the clamping jaws with the pipe into the device, prestressing the clamping jaws in the cone plate and releasing the clamping jaws from the pipe again after shaping.

The prior eat also includes devices in which a separate clamping cylinder is arranged at a 90° angle to the shaping cylinder. The clamping elements are usually cuboidal and divided in two (not conical). Such a construction is distinguished by a high degree of operating convenience as the clamping jaws are moved automatically via the clamping cylinder. However, it is disadvantageous that the hydraulic clamping system has to be designed for very high clamping forces as no increase in the clamping force, for example via a cone system, takes place during the shaping process, so that the clamping force is usually dimensioned to be 1.5 times the shaping force. This design therefore leads to high weight, a large construction space, high equipment costs and low cycle times when the pipe is clamped.

From German utility model DE 94 10 419 U1, a device for the plastic shaping of pipe ends is known which represents a combination of the shaping devices described above, that is to say a system with a separate clamping cylinder arranged at a 90° angle to the shaping cylinder and with conical clamping jaws. In this device, the pipe is prestressed with a low force via the clamping cylinder. The prestressing force is then increased via the cylinder and the cone system when the shaping process is initiated. However, it is disadvantageous in this connection that, during the shaping process, the entire shaping force reacts on the prestressing cylinder, and is even increased many times over via a taper angle which is very flat. In spite of the low prestressing force, the entire clamping system therefore has to be designed for very high forces, which leads to high weight, a large construction space and high costs.

DE 195 11 447 A1 describes a device of the type referred to in the introduction for forming the end region of a pipe for use in screw connections. In this known device, the shaping cylinder and prestressing cylinder are arranged coaxially with one another. The prestressing piston is in the form of an annular piston and is located on the piston rod of the shaping piston. The pipe is prestressed by means of the prestressing piston and the conical clamping jaws. During the shaping process, the clamping force is increased by the force of the shaping piston which is introduced. In this design, the pistons engaging with one another and the surrounding housing parts must be aligned accurately with one another in order to guarantee functioning and sealing of the machine. The design is therefore very involved and expensive as far as manufacturing is concerned. Moreover, the rear, conical housing part has to be removed completely for tool change. As this connection location has to transmit the entire shaping force, it is scarcely possible to implement a rapid closure in this location. This leads to long tool-change times. Tool change is involved and, owing to the poor accessibility, not operator-friendly. Owing to the closed housing design and the annular prestressing piston, the shaping region is completely concealed. Visual monitoring of the shaping operation by the operator is therefore not possible.

The circumstances are similar for the subject of German patent specification DE 100 40 596 C1 (and of the German laid-open specification DE 100 40 595 A1 relating to the associated method), according to which the shaping device corresponds in its basic construction to the device described in DE 195 11 447 A1. The same disadvantages arise, such as great complexity in terms of manufacturing, involved tool change and correspondingly long tool-change times and also the impossibility of carrying out visual monitoring of the shaping process. Moreover, as the fluid pressure used for shaping acts on the pressure chamber serving for prestressing the pipe, a pressure relief valve designed as an overpressure valve must be provided in this chamber.

The present invention is based on the object of providing a device for the deformation of workpieces, in particular for the plastic shaping of pipe ends, of the type referred to in the introduction, which, while having high functionality, compact construction dimensions and low weight, is distinguished by reduced complexity as far as apparatus and manufacturing are concerned. Furthermore the device according to the invention is also to have increased operator-friendliness by virtue of allowing simple and rapid tool change and also visual monitorability of the shaping process by the operator.

According to the invention, this is achieved by a device of the type referred to in the introduction, in which the shaping unit and the prestressing unit are designed as constructional units which are interconnected but completely closed off in relation to one another.

Owing to the embodiment of the device according to the invention, it is first of all possible to reduce manufacturing complexity considerably as the constructional units which are completely closed off in relation to one another require lower finishing accuracy than the known devices produced using components engaging in one another, such as annular pistons, it being possible according to the invention for both the shaping unit and the prestressing unit to be formed by commercially available pneumatic or in Particular double-acting or single-acting hydraulic cylinders. In this connection, the entire prestressing unit advantageously has to be designed only for small forces (low pressure), and therefore the entire device according to the invention can be produced with relatively compact construction dimensions and low weight.

In contrast to a device in which a clamping cylinder is arranged at an angle of 90° to the shaping unit, it is to be emphasized for the invention that it has no space requirement for clamping cylinders in the radial direction and that therefore, for example, no problems can arise when shaping pipes bent in a U-shape.

Furthermore, in particular a simple and rapid tool change is advantageously possible as the device according to the invention allows a constructional embodiment which requires no demounting of (pressure-bearing) housing parts for the purpose of tool change and which in addition affords very good accessibility to the tool space. Shaping tools, such as clamping elements or upsetting heads, can thus be fixed detachably very rapidly by virtue of being, for example, inserted into guide grooves which are accessible from above and being held there by their dead weight.

Finally, the device according to the invention can be manufactured in closed or open style, the latter making possible visual monitorability of the shaping process by the operator.

Further advantageous design features of the invention are contained in the dependent claims and the description below.

The invention is now to be explained in greater detail with reference to a preferred illustrative embodiment shown in the drawing, in which.

Figure 1:
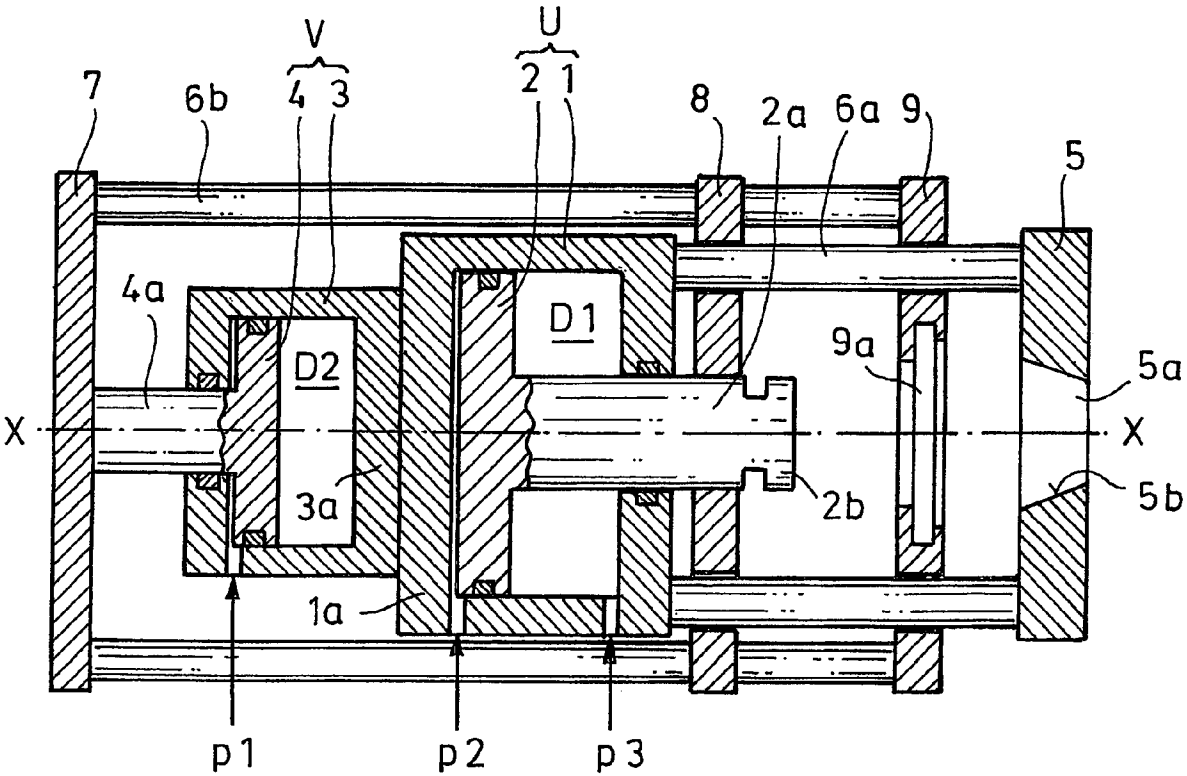
FIG. 1 shows from a viewing direction from above a longitudinal section through a device according to the invention for the deformation of workpieces, in particular for the plastic shaping of pipe-ends.
Figure 5A:
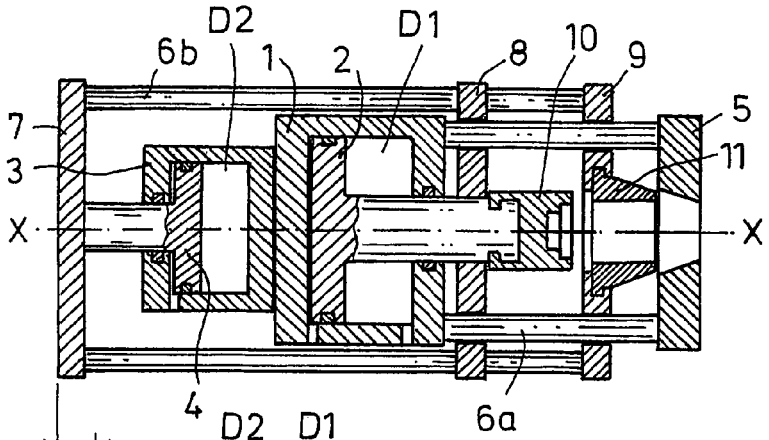
Figure 5B:
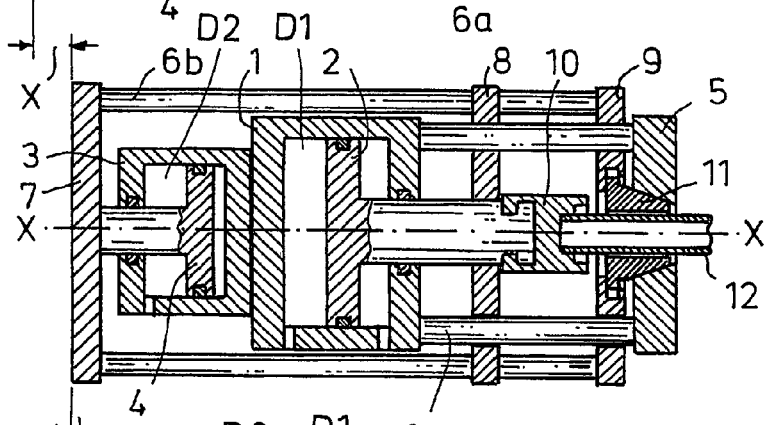
Figure 5C:
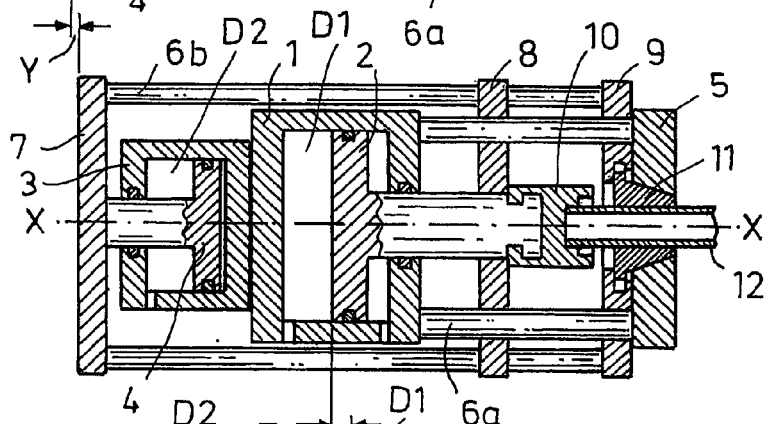
Figure 5D:
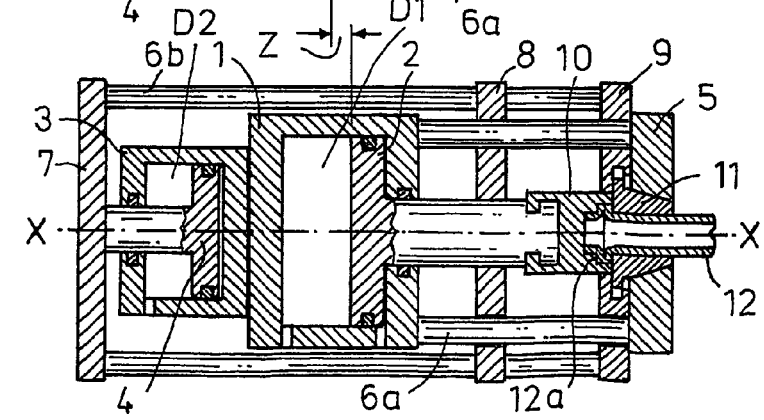

FIG. 5*a* shows a device according to the invention in a position for the tool change in an illustration corresponding to FIG. 1;

FIG. 5*b* shows a device according to the invention in a position for insertion of the workpiece in an illustration corresponding to FIG. 1;

FIG. 5*c* shows a device according to the invention in a position for clamping the workpiece in an illustration corresponding to FIG. 1, and FIG. 5*d* shows a device according to the invention in a position for shaping the workpiece in an illustration corresponding to FIG. 1.

In the various figures of the drawing, identical parts and parts corresponding to one another are always provided with the same references and are therefore also as a rule each described only once.

As emerges first of all from FIG. 1, a device according to the invention for the deformation of workpieces, in particular for the plastic shaping of pipe ends, has a shaping unit U actuated by the pressure p2 of a fluid and a prestressing unit V arranged on a common longitudinal axis X-X and actuated by the pressure p1 of a fluid. The shaping unit U is formed by an in particular double-acting cylinder 1 and by a piston 2 movable axially therein. The prestressing unit V is formed by an in particular single-acting cylinder 3 and by a piston 4 movable axially therein. In the shaping unit U and in the prestressing unit V, in each case at least one separate (double-chambered) pressure space D1, D2 is formed, which can be pressurized independently of the pressure space D2, D1 of the other unit V, U in each case. Both pressure spaces D1, D2—that of the shaping unit U and that of the prestressing unit V—have a full-area, preferably circular shape in the cross section running transversely to the longitudinal axis X-X. (In this connection, "full-area" means that the area is not of annular or frame-like design or interrupted by "holes".)

The shaping unit U and the prestressing unit V are closed off in relation to one another by at least one wall running transversely to the longitudinal axis X-X (in particular by the walls designated as the rear wall 1*a* of the cylinder 1 of the shaping unit U and as the rear wall 3*a* of the cylinder 3 of the prestressing unit V). The shaping unit U and the prestressing unit V are therefore designed as constructional units which are on the one hand interconnected but on the other hand completely closed off in relation to one another.

The device according to the invention consists essentially of three main assemblies which are moved relative to one another parallel to the longitudinal axis X-X during the shaping process. In order better to illustrate the functioning, components which belong to a main assembly are in each case provided with the same hatching in FIG. 1 (and also FIGS. 5*a* to 5*d*).

The first main assembly, which is stationary in the present example, consists of the cylinders 1, 3 of the shaping unit U and the prestressing unit V and of a yoke plate 5 arranged transversely to the longitudinal axis X-X, which are all rigidly interconnected. Tie rods 6*a*, which serve for forming the rigid connection and for force transmission between the cylinder 1 of the shaping unit U and the yoke plate 5, are arranged parallel to the longitudinal axis X-X. A bore 5*a*, which is arranged coaxially with the cylinder 1 of the shaping unit U and tapers conically away from the shaping unit U, is located in the yoke plate 5.

In a second main assembly, the piston 4 of the prestressing unit V, via its piston rod 4*a* and an adapter part 7, such as the adapter plate illustrated arranged transversely to the longitudinal axis X-X, a driver plate 8, likewise arranged transversely to the longitudinal axis X-X, for the piston 2 of the shaping unit U, and a receiving plate 9, arranged transversely to the longitudinal axis X-X, for clamping elements (described in greater detail below) are rigidly interconnected. Located in the driver plate 8 is a bore (not described further) which is arranged coaxially with the cylinder 1 of the shaping unit U and in which the piston 2 of the shaping unit U is guided, in particular with its piston rod 2*a*. Located in the receiving plate 9 is a step-shaped cutout 9*a* which, as attachment means for insertion of the clamping elements, is open upwardly. Tie rods 6*b*, which serve for forming the rigid connection and for force transmission between the piston 4 of the prestressing unit V and the two plates 8, 9, are again arranged parallel to the longitudinal axis X-X.

The third main assembly consists of only the piston 2 of the shaping unit U.

Figure 2:
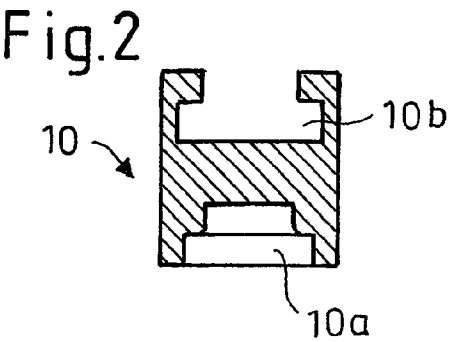
FIG. 2 shows in longitudinal section an upsetting head for the device according to the invention illustrated in FIG. 1.
Figure 3:
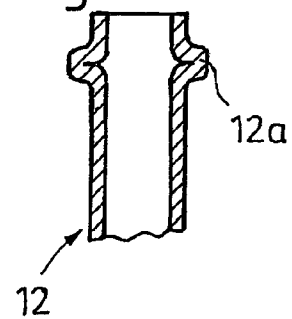
FIG. 3 shows in longitudinal section an example of a pipe end shaped using the device according to the invention.
Figure 4:
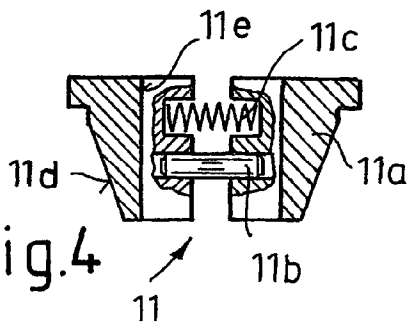
FIG. 4 shows in longitudinal section a clamping element for the device according to the invention illustrated in FIG. 1.

For shaping, a tool set is required, which consists of an upsetting head 10 (FIG. 2) and at least one clamping element 11 (FIG. 4). To illustrate the shaping process, a pipe end 12 has been selected as an example, which has the bead, contour 12*a* illustrated in FIG. 3. With the device according to the invention, however, any axially upsettable pipe contour can be produced.

The upsetting head 10 comprises on one side a recess 10*a*, the counter contour of the pipe contour 12*a* to be formed, and on the opposite side a connection possibility 10*b* for the piston 2 of the shaping unit—in the present case a T-groove. Correspondingly, the shaping unit U, in particular a free end of the piston rod 2*a* of the piston 2, likewise has attachment means 2*b* for detachable attachment of the upsetting head 10.

The clamping element 11 is formed by clamping jaws 11*a* which consist of several, preferably four, segments arranged in a ring-shaped manner. These are usually guided by means of cylindrical pins 11*b* and held in an open position in the unloaded state by means of compression springs 11*c*. They interact with the conical surface of the opening 5*a* in the yoke plate 5 and for this purpose likewise have outer surfaces 11*d* of conical design. When clamping takes place, the clamping jaws 11*a* press on the pipe 12 with their inner side 11*e*, which is usually slightly roughened or toothed.

The mode of operation of the device according to the invention is illustrated by the figure sequence 5*a* to 5*d*.

In the tool-change position illustrated in FIG. 5*a*, the tools (upsetting head 10, clamping jaws 11*a*) can be inserted from above into the corresponding seats 2*b*, 9*a*, good accessibility to the tool space being afforded. It is not necessary to demount components of the device for tool change.

FIG. 5*b* shows the insertion position for the workpiece. From the end position shown in FIG. 5*a*, the entire second main assembly moves, under the action of the fluid pressure p1 in the pressure space D2, parallel to the longitudinal axis X-X by an amount. X relative to the first (stationary) main assembly (toward the right in the diagrammatic illustration). In the process, the piston 2 of the shaping unit U which is in a state of unpressurized circulation is also taken along by means of the driver plate 8. The clamping jaws 11*a* are still slightly open in the insertion position, so that the pipe 12 can be guided cleanly when inserted, until its end comes up against a contact surface (not described further) in the recess 10*a* in the upsetting head 10.

The clamping of the pipe 12 (FIG. 5*c*) then takes place. The entire second assembly, the prestressing unit, is again moved parallel to the longitudinal axis X-X, this time by the amount Y (toward the right). In this connection, by virtue of the interaction of the conical surfaces 11*d* of the clamping jaws 11*a* and the conical surface 5*b* in the yoke plate 5, the clamping jaws 11*a* are closed without gaps counter to the force of their springs 11*c* and the pipe 12 is secured.

With suitable selection of the piston areas of the pistons 2, 4, all the movements of the second main assembly described so far can be effected at the same pressure level as applies for the shaping unit U. Advantageously, however, the prestressing unit V can also be operated in the low-pressure range.

The shaping process (FIG. 5*d*) known per se, in which the bead 12*a* is formed on the pipe 12 in a manner known per se during an axial movement of the piston 2 by the amount Z, is initiated by means of the pressure p2 of the fluid on the piston 2 of the shaping unit U and requires high forces. The shaping unit U is therefore preferably designed for the high-pressure range. Owing to the fact that, with regard to the forces arising in them, the first and the second main assemblies each constitute self-contained separate systems which are coupled indirectly as far as forces are concerned only via the clamping jaws 11*a* held in the receiving plate 9 and pressed into the yoke plate 5, however, the prestressing, unit V, or the second main assembly, is not loaded additionally by the high shaping forces and can therefore be dimensioned in its entirety for low forces, advantageously by means of a low-pressure design. It is true that the conical shape of the clamping elements leads to the prestressing force introduced by means of the prestressing unit V being further increased during pipe-shaping, but no reaction of the shaping force on the prestressing unit V takes place, as arises in the case of the device known from DE 100 40 595 A1.

To remove the pipe, the tool-change position (FIG. 5*a*) is taken up again, which can be brought about under the action of a fluid counter pressure p3 in the pressure space D1 of the shaping unit U. Alternatively, it would also be possible for this purpose to provide only a single-acting cylinder, with spring return or a reversible driver mechanism, in the shaping unit U in place of a double-acting cylinder and instead to provide a double-acting cylinder in the prestressing unit V.

The invention is not limited to the illustrative embodiment shown but also includes all embodiments acting in the same way according to the spirit of the invention. In particular, a kinematic reversal is also possible in the sense that the prestressing second main assembly is stationary and does not move and serves as a machine frame or is fixed to a machine frame. In this case, the first main assembly is moved axially with the yoke plate 5, which has the advantage that the pipe 12 is not moved after reaching the axial pipe stop position. (In the variant described above, the pipe 12 is moved by the amount Y when clamping takes place.)

The device according to the invention can also be embodied with the same level of functionality with a prestressing unit V rotated through 180°. The rear wall 3*a* of the cylinder 3 of the prestressing unit V then bears against the adapter plate or can itself be designed as an adapter part 7, and the piston 4 is coupled to the rear wall 1*a* of the cylinder 1 of the shaping unit U.

Lastly, instead of the open housing constructed with the tie rods 6*a*, 6*b*, a housing with connecting plates or, as in the case of the known annular piston systems, a rotationally symmetrical, tubular housing could also be made.

Furthermore, the invention is not limited to the feature combination defined in claim 1 but can also be defined by any other combination of features of all the individual features disclosed as a whole. This means that in principle any individual feature of claim 1 can be omitted or replaced by at least one feature disclosed elsewhere in the application. In this respect, claim 1 is to be understood simply as a first formulation attempt for an invention.

REFERENCES

1 cylinder of U
1*a* rear wall of 1
2 piston of U
2*a* piston rod of 2
2*b* attachment means on 2
3 cylinder of V
3*a* rear wall of 3
4 piston of V
4*a* piston rod of 4
5 yoke plate
5*a* bore in 5
5*b* conical surface in 5
6*a*, 6*b* tie rod
7 adapter part
8 driver plate for 2
9 receiving plate for 11
9*a* cutout in 9
10 upsetting head
10*a* recess in 10
10*b* connection of 10 for 2*b*
11 clamping element
11*a* clamping jaw
11*b* cylindrical pin
11*c* compression spring
11*d* outer surface of 11*a*
11*e* inner surface of 11*a*
12 pipe (end)
12*a* bead on 12
D1 pressure space of U
D2 pressure space of V
p1, p2, p3 fluid pressures U shaping unit
V prestressing unit
X, Y movement amounts of 4
X-X longitudinal axis
z movement amount of 2

The invention claimed is:

1. A device for the plastic shaping of pipe ends comprising a shaping unit actuated by a first fluid pressure, a prestressing unit arranged on a common longitudinal axis with the shaping unit and actuated by a second fluid pressure, a clamping element of conical design which can be clamped by the prestressing unit, at least a first and a second separate pressure space being provided in the shaping unit and in the prestressing unit respectively, wherein the first and the second pressure spaces lack fluid communication therebetween such that the pressure spaces can be pressurized independently of each other, and the shaping unit and the prestressing unit are designed as constructional independent units which are mechanically interconnected but the first and second pressure spaces are completely separate in relation to one another.

2. The device as claimed in claim 1 wherein the shaping unit and the prestressing unit are closed off in relation to one another by at least one wall running transversely to the longitudinal axis.

3. The device as claimed in claim 1 wherein the first and the second pressure spaces have a full-area, circular shape in the cross section running transversely to the longitudinal axis.

4. The device as claimed in claim 1 wherein the shaping unit is formed by a first cylinder and by a first piston movable axially therein, the first piston being acted upon by the first fluid pressure.

5. The device as claimed in claim 4 wherein the prestressing unit is formed by a second cylinder and by a second piston movable axially therein being actuated upon by the second fluid pressure.

6. The device as claimed in claim 5 wherein the first cylinder of the shaping unit includes a first rigid connection to is one of the second cylinder or the second piston of the prestressing unit to form a first main assembly with a yoke plate arranged transversely to the longitudinal axis.

7. The device as claimed in claim 6 wherein an opening for interaction with the clamping elements, which is arranged coaxially with the longitudinal axis and tapers conically away from the shaping unit is located in the yoke plate.

8. The device as claimed in claim 6 wherein the rigid connection between the first cylinder of the shaping unit and the yoke plate is formed by one or more first tie rods.

9. The device as claimed in claim 6 wherein one of the second piston of the prestressing unit, or the second cylinder of the prestressing unit includes a second rigid connection to an adapter plate to form a second main assembly with a driver plate arranged transversely to the longitudinal axis, and to a receiving plate arranged transversely to the longitudinal axis.

10. The device as claimed in claim 9 wherein the first rigid connection between the first cylinder and the second cylinder or the second piston of the prestressing unit and the driver plate and the receiving plate is formed by one or more second tie rods.

11. The device as claimed in claim 9 wherein the first piston of the shaping unit, the first main assembly and the second main assembly are displaceable relative to one another parallel to the longitudinal axis.

12. The device as claimed in claim 11 wherein the first main assembly or the second main assembly is arranged in a stationary manner and connected to a fixed frame.

13. The device as claimed in claim 4 wherein a free end of a piston rod of the first piston has first attachment means for detachable attachment of an upsetting head.

14. The device as claimed in claim 9 wherein the receiving plate for the clamping elements has second attachment means for detachable attachment of the clamping elements.

15. The device as claimed in claim 1 wherein an upsetting head, which on one side has a recess designed as the counter for a pipe contour to be formed and on the opposite side a connection means for the shaping unit is provided.

16. The device as claimed in claim 1 wherein the clamping elements are formed by clamping jaws which consist of a plurality of segments arranged in a ring-shaped manner and each having an outer surface of conical shape, which are guided by means of one or more pins and held in an open position in an unloaded state by means of one or more compression springs.

17. The device as claimed in claim 4 wherein in the operating state, the first fluid pressure is greater than the second fluid pressure.

18. The device as claimed in claim 1 wherein the first cylinder is a double acting cylinder acted upon on the opposite sides thereof by the first fluid pressure in the first pressure space and by a third fluid pressure acting in a third pressure space.

19. The device as claimed in claim 15 wherein the connection means includes a T-groove.

* * * * *

UNITED STATES PATENT AND TRADEMARK OFFICE

CERTIFICATE OF CORRECTION

PATENT NO. : 7,237,420 B2
APPLICATION NO. : 10/511195
DATED : July 3, 2007
INVENTOR(S) : Gebra Berghaus It is certified that error appears in the above-identified patent and that said Letters Patent is hereby corrected as shown below:

Column 7, claim 6, line 40, after "to" delete "is".

Signed and Sealed this

Thirteenth Day of November, 2007

JON W. DUDAS
*Director of the United States Patent and Trademark Office*